US008770268B2

(12) United States Patent
Schenker et al.

(10) Patent No.: US 8,770,268 B2
(45) Date of Patent: Jul. 8, 2014

(54) PLATE-TYPE EXCHANGER, HEAT EXCHANGER PLATE AND METHOD FOR PRODUCING SAME

(75) Inventors: Friedrich Schenker, Guglingen (DE); Volker Wagner, Muhlacker (DE)

(73) Assignee: API Schmidt-Bretten GmbH & Co. KG, Bretten (DE)

( * ) Notice: Subject to any disclaimer, the term of this patent is extended or adjusted under 35 U.S.C. 154(b) by 760 days.

(21) Appl. No.: 12/921,800

(22) PCT Filed: Jan. 29, 2009

(86) PCT No.: PCT/EP2009/000568

§ 371 (c)(1),
(2), (4) Date: Sep. 10, 2010

(87) PCT Pub. No.: WO2009/112128

PCT Pub. Date: Sep. 17, 2009

(65) Prior Publication Data

US 2011/0011571 A1 Jan. 20, 2011

(30) Foreign Application Priority Data

Mar. 10, 2008 (DE) ..... 10 2008 013 358

(51) Int. Cl.
*F28F 3/00* (2006.01)
*F28F 19/00* (2006.01)

(52) U.S. Cl.
USPC ..... 165/134.1; 165/167

(58) Field of Classification Search
USPC ..... 165/134.1, 133, 153, 164, 165, 166, 165/167, 168, 170
See application file for complete search history.

(56) References Cited

U.S. PATENT DOCUMENTS

| | | | | |
|---|---|---|---|---|
| 3,880,232 | A * | 4/1975 | Parker | 165/166 |
| 4,586,562 | A * | 5/1986 | Carlson et al. | 165/134.1 |
| 5,443,115 | A * | 8/1995 | Pedersen et al. | 165/70 |
| 5,800,673 | A * | 9/1998 | Okuda et al. | 159/28.6 |
| 6,769,479 | B2 * | 8/2004 | Fitzpatrick et al. | 165/166 |
| 7,357,126 | B2 * | 4/2008 | Durand et al. | 123/568.11 |
| 2008/0093064 | A1 * | 4/2008 | Gianazza et al. | 165/180 |

FOREIGN PATENT DOCUMENTS

| | | | |
|---|---|---|---|
| DE | 8310039 | | 6/1983 |
| EP | 0252275 | | 6/1987 |
| EP | 0671240 | | 9/1995 |
| FR | 2544060 | | 4/1984 |
| GB | 2085144 | | 4/1982 |
| JP | 59032793 | A * | 2/1984 |

* cited by examiner

*Primary Examiner* — Tho V Duong
(74) *Attorney, Agent, or Firm* — Volpe and Koenig, P.C.

(57) ABSTRACT

A heat exchanger plate (3*a*) for a plate-type heat exchanger having throughflow openings (4-7), which are arranged adjacent to one another in the plane of the plate, for fluid media is provided. The heat exchanger plate (3*a*) is formed from a first material, in particular steel or high-grade steel, and those surfaces (18*a*, 19*a*, 20*a*) of the heat exchanger plate (3*a*) which come into contact with one of the fluid media are formed from, or lined, with another material which is in particular more corrosion resistant than the first material.

18 Claims, 5 Drawing Sheets

PLATE-TYPE EXCHANGER, HEAT EXCHANGER PLATE AND METHOD FOR PRODUCING SAME

BACKGROUND

The present invention relates to a heat-exchanger plate for a plate-type heat exchanger with through-flow openings for fluid media, wherein these openings are arranged one next to the other in the plane of the plate and wherein the heat-exchanger plate is produced from a first material, in particular, steel or high-grade steel.

Furthermore, the present invention relates to a plate-type heat exchanger for fluid media with at least one inlet and at least one outlet for a first, in particular, slightly aggressive medium, with at least one inlet and at least one outlet for a second, aggressive medium, and with a number of heat-exchanger plates that are arranged in active fluid connection with the inlets and outlets in the plate-type heat exchanger.

Finally, the present invention relates to a method for the production of a heat-exchanger plate according to the invention.

Plate-type heat exchangers of the type noted above are known, for example, from EP 0 252 275 A2 and an example is shown in the accompanying FIG. 1.

FIG. 1 shows, in an exploded view, a known heat exchanger in which a package of essentially rectangular heat-exchanger plates 3 that are the same as each other and are rotated alternately relative to each other by 180° are mounted between end plates 1, 2. In the corner regions of the plates 3, through-flow openings 4-7 are formed by breaks that produce channels 9-12 when plate packages are pushed together, as shown by reference symbol 8, wherein two fluid media are fed alternately by means of these channels to the spaces formed between the plates 3 for mutual heat exchange.

Alternatively or additionally, the through-flow openings 4-7 could also be arranged in other plate regions, in particular, the plate longitudinal sides.

The spaces between the plates 3 for the fluid media are closed to the outside and in an alternating manner relative to the channels of one medium or the other medium by seals 13, so that one medium flows through one plate intermediate space and the other medium flows through the following plate intermediate space.

The four ports 14 attached to the end plate 2 on the outside are used for connections for the feeding and discharge of the two media. In addition, the heat-exchanger plates 3 between the end plates 1 and 2 are guided by bars engaging in recesses of the plates 3, wherein, of these bars, only the lower bar 15 is shown explicitly in FIG. 1. Alternatively, the connections could also be arranged on the other end plate 1.

The above functional description also applies to the present invention.

In the practical application of such plate-type heat exchangers or heat-exchanger plates, it can occasionally happen that one of the heat-exchanging media produces an especially aggressive, in particular, corrosive effect with respect to the plate material. In this case, the heat-exchanger plates must be produced from a corrosion-resistant material that withstands the aggressive properties of the medium. This, however, is associated with considerable added costs.

In this context, DE 83 10 039 U1 discloses the deposition of a full-surface, high-quality covering layer on at least one side of a heat-exchanger plate. In this way, the mentioned added costs are avoided only in part.

SUMMARY

The invention is based on the objective of refining heat-exchanger plates of the type named above to the extent that they are also suitable for very aggressive media, without producing the previously mentioned cost disadvantages. At the same time, a method for the production of corresponding heat-exchanger plates should be specified.

The invention meets this objective with respect to the heat-exchanger plate with the features of the invention and with respect to the production method.

Preferred refinements of the present invention are the subject matter of subordinate claims, whose wording is incorporated herewith into the description through explicit reference, in order to avoid unnecessary repetition of text.

According to the invention, a heat-exchanger plate for a plate-type heat exchanger with through-flow openings that are arranged one next to the other in the plane of the plate for fluid media, wherein this heat-exchanger plate is produced from a first material, in particular, steel or high-grade steel, is characterized in that the heat-exchanger plate is made from a different material or is coated with this material essentially only in those partial regions of their surface on their front and or back side in which the heat-exchanger plate comes into contact with a certain fluid medium, in particular, the relatively more aggressive of the fluid media.

Furthermore, the present invention creates a method for the production of a heat-exchanger plate for a plate-type heat exchanger with through-flow openings arranged one next to the other in the plane of the plate for fluid media, wherein initially an unfinished sheet is formed into a heat-exchanger plate in a first material, such as, steel, in particular, high-grade steel, and then the unfinished sheet is coated on its surfaces coming in contact with the media at least in partial regions with a second, in particular, higher-grade material. Then the shaping is performed to form the final heat-exchanger plate.

In this way it is possible according to the invention to selectively influence the created heat-exchanger plate in the mentioned partial regions by the coating with the second material in its resistive force, in particular, to increase its corrosion resistance relative to aggressive media, without requiring the entire plate to be constructed in the higher-grade, more expensive material.

Preferred improvements of the heat-exchanger plate according to the invention provide that the second material is of higher grade, i.e., in particular, is more corrosion resistant than the first material, wherein the second material advantageously involves high-alloy high-grade steels, titanium, tantalum, or the like. One possible material combination for the heat-exchanger plate according to the invention thus provides that this is constructed, in principle, from the conventional material, such as steel or high-grade steel, and is coated at least in partial regions with a higher-grade material.

Advantageously, the second material is deposited in the mentioned partial regions on the first material through aluminization, vacuum deposition, anodization, sherardizing, chrome diffusion, phosphatization, vitreous enameling, plating, injection methods, hot dipping, galvanic action, but in particular through soldering, hard soldering, or welding.

In general, the heat-exchanger plate is loaded in a large surface area region used for heat transfer and the connection regions in flow connection with this region by one medium, while it is loaded in two or more adjacent connection regions that are used for passing through the other medium by this other medium. On the rear side of the plate, the conditions are then reversed. The regions loaded by the different media are each separated from each other by seals. According to on which plate side the aggressive medium flows, the plate is coated with the more corrosion resistant material either only in the two relatively small connection regions for the aggressive medium or also in the heat-exchanging region connected to these regions.

The main savings are produced on the plate side that is loaded by the slightly aggressive medium, because only the relatively small connection regions for the passing through of the aggressive medium are to be occupied there with the more corrosion resistant material.

Here, it lies in the scope of the invention to produce the plate on the side where it is loaded over a large surface area by the aggressive medium continuously from the higher-grade material. However, it is especially advantageous to omit the two connection regions for passing through the slightly aggressive medium and to coat with the more economical, less corrosion-resistant material.

The wall thickness of the higher-grade material coating like also the lower-grade material coating should advantageously be equal for cost reasons, so that no material offset with additional expense must be bridged on the surrounding edge seals of the plates in the peripheral direction.

Usually, the regions of the plates loaded by different media are separated from each other by two seals. Then it is recommended to let the transitions between adjacent material coatings with different corrosion resistance run in the regions not loaded by flow between the two mentioned seals.

To summarize it can be stated that a heat-exchanger plate according to the invention is advantageously coated only in those partial regions on its front and/or rear side with the second, in particular, higher-grade material, where it is actually required due to the given media contact, in order to achieve the desired cost advantages.

Due to the different constructions of the front and rear sides, in a subsequent refinement of the present invention it is necessary to provide two different types of heat-exchanger plates that can be inserted alternately in the plate-type heat exchanger according to the class. Here, one plate construction is produced, in particular, just by mirroring the other about the center longitudinal axis of the plate.

BRIEF DESCRIPTION OF THE DRAWINGS

Additional features and advantages of the present invention are given from the following description of embodiments and from the drawing. Shown are.

DETAILED DESCRIPTION OF THE PREFERRED EMBODIMENTS

Figure 1:
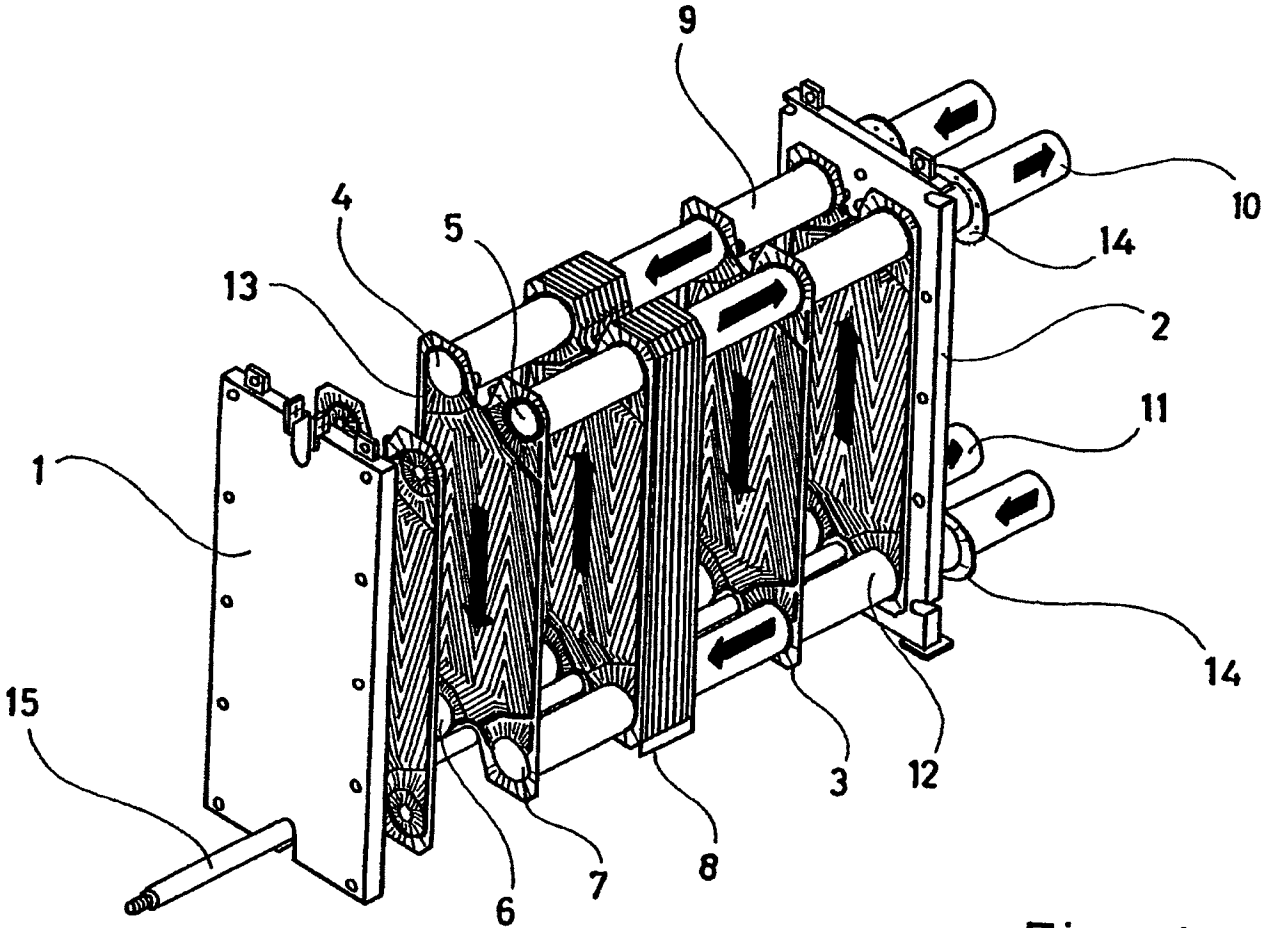
FIG. 1, a perspective exploded view of a known plate-type heat exchanger.

A plate-type heat exchanger of the type shown in FIG. 1 and explained farther above is generally known as such to someone skilled in the art. The present invention is concerned at the start especially with the problem that occurs when one of the media being fed to the plate-type heat exchanger involves a relatively aggressive medium that is in the position to attack the material of the heat-exchanger plates 3, in particular, through corrosion. In this context, the present invention provides that the heat-exchanger plates 3 are produced locally from a more corrosion-resistant material.

In the figures, the different types of materials are shown by different shadings. Here, uniform shading made from solid lines designates a (relatively) lower grade material and shading made from solid and dashed lines designates a relatively high-grade, more corrosion resistant material. In the course of the present invention, the high-grade material advantageously involves tantalum (Ta) and the lower-grade material involves high-grade steel. However, the present invention is not limited to such material combinations.

Figure 2:
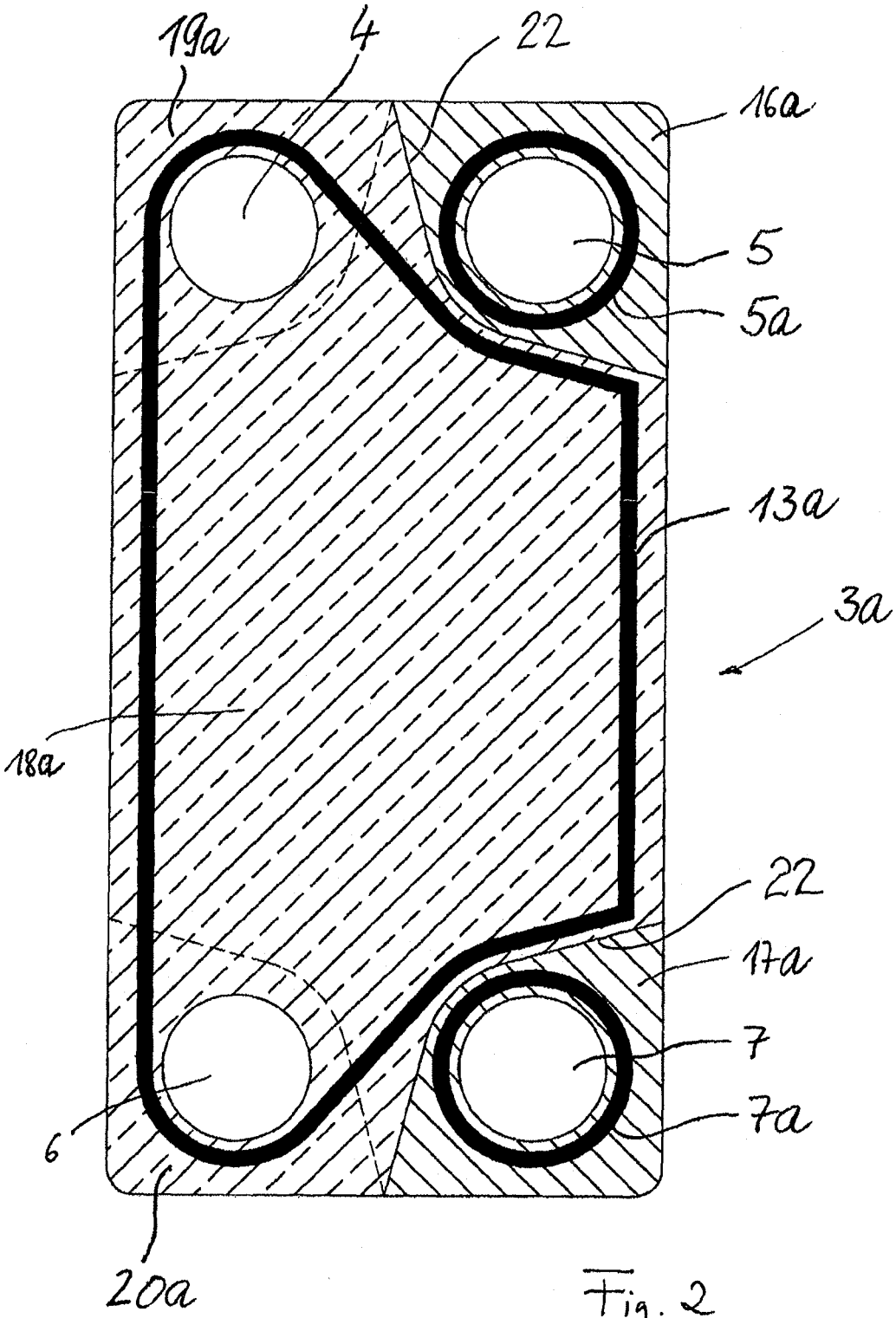
FIG. 2, a schematic front view of a heat-exchanger plate according to the invention for a large surface area contact with an aggressive medium, FIG. 3, a schematic front view of a heat-exchanger plate according to the invention for a large surface area contact with a less aggressive medium, FIG. 4, in a schematic diagram, the top side of an unfinished sheet for the production of the heat-exchanger plate according to the invention in FIG. 2, FIG. 4*a*, a section view along the line A-A in FIG. 4, FIG. 4*b*, a section view along the line B-B in FIG. 4, FIG. 5, a view of the unfinished-sheet top side for the heat-exchanger plate according to the invention in FIG. 3, FIG. 5*a*, a section view along the line C-C in FIG. 5, FIG. 5*b*, a section view along the line D-D in FIG. 5.

FIG. 2 shows schematically a heat-exchanger plate 3*a* with its front side designed for an aggressive or corrosive medium; that is, this side is turned toward a plate-type intermediate space that is coated with the aggressive medium. For this purpose, it could be coated according to the invention on its front side across its entire surface with the higher-grade material. Now, however, because the plate region charged effectively by the aggressive medium is limited by the typical seal 13*a* defining the heat-exchanging region, the regions of the plate front side not coming in contact with the aggressive medium could be made from or coated with the conventional base material. These regions could begin directly on the seal 13*a*, for example, at the deepest position of the seal groove or bordering on the outside. Frequently, however, for reasons of symmetry to produce or coat only the connection regions with the more economical base material around the openings 5 and 7, that is, around those openings that carry a flow of the less aggressive medium and are surrounded by the typical seals 5*a* and 7*a*. These regions are marked by the reference symbols 16*a* and 17*a*. They advantageously extend up to the center of the plate narrow side. From there, they run in the direction of the seal 13*a* and then bend in the intermediate region between the seals 5*a*, 7*a*, and 13*a* until they reach the plate width side. Here it can also be seen that the transitions between the adjacent differing corrosion-resistant material coatings, such as regions 16*a* or 17*a* that carry a flow of the less aggressive medium to region 18*a* that carries a flow of the relatively more aggressive medium, extend into regions of the plate not charged with flow, indicated by the transition lines 22, outside of the seals 5*a*, 7*a*.

Figure 3:
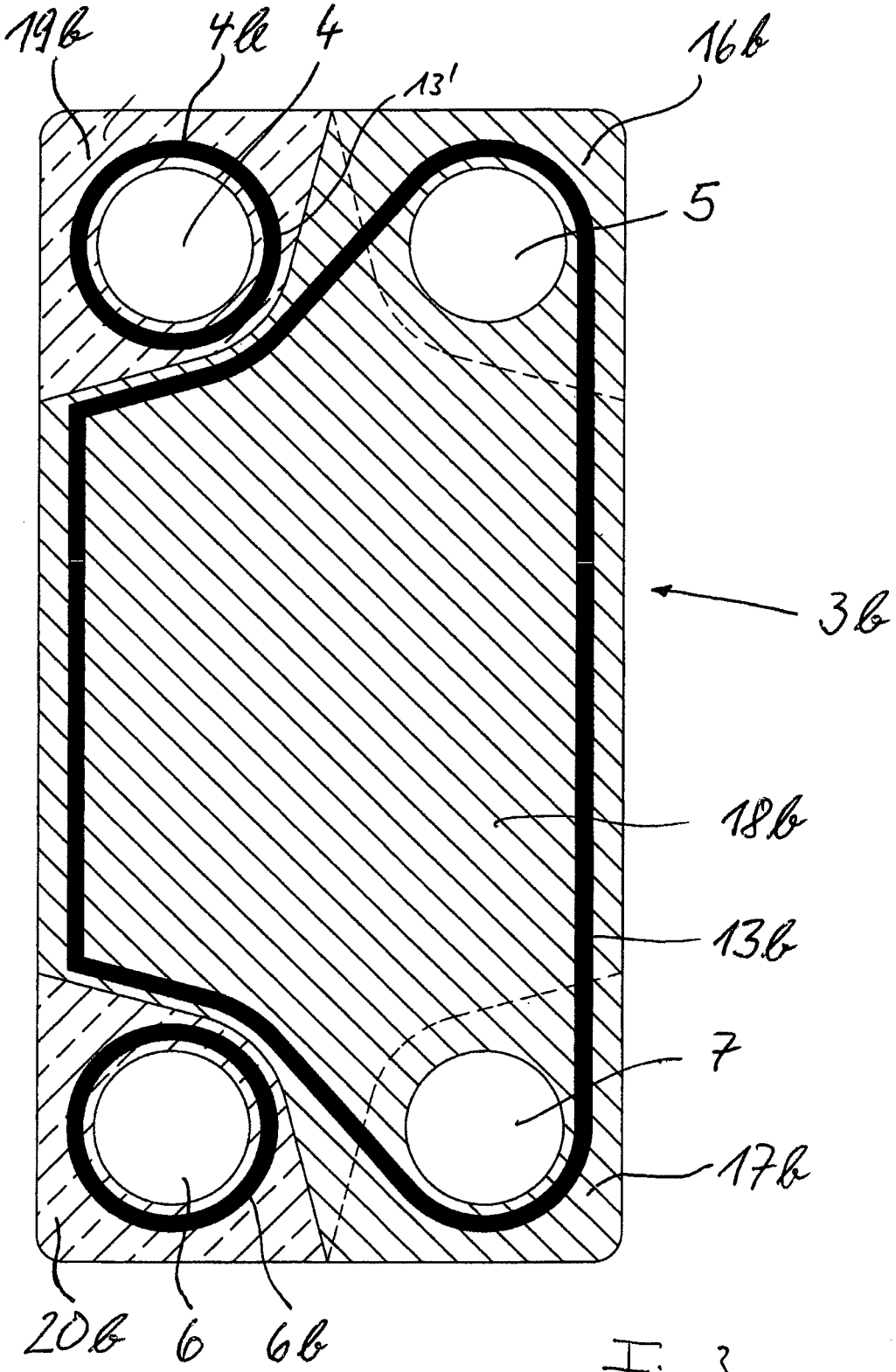

The plate 3*b* following the heat-exchanger plate 3*a* is shown in FIG. 3 with its front side. It has the same seal configuration as the rear side of the plate 3*a*, that is, the intermediate space formed between both plates is charged by the less aggressive medium fed through the openings 5 and 7. Here, the heat-exchanging surface 18*b* enclosed by the seal 13*b* with the connection regions 16*b* and 17*b* surrounding the openings 5 and 7 are made from the more economical, less resistant material, while the connection regions 19*b* and 20*b* with the openings 4 and 6 surrounded by seals 4*b* and 6*b*, respectively, are made from the more resistant material or must be covered with this material, because the more aggressive medium flows in these openings.

As can be seen, all of the connection regions 16*a, b*; 17*a, b*; 19*a, b*; 20*a, b* have the same size and contours, so that the plate obtains, in this respect, a symmetric construction.

Behind the plate 3*b*, a plate of type 3*a* then follows again, so that the intermediate space lying behind the plate 3*b* again carries a flow of the more aggressive medium and thus the sequence of heat-exchanger plates repeats with alternating material and seal configuration in a known manner.

Obviously, the plates 3*a* and 3*b* could be profiled in a known manner by ribs, knobs, or the like, in order to improve the heat transfer.

The relationships of the plate construction according to the invention described above are explained in detail below with reference to FIGS. 4 and 5. Each of these shows section views of unfinished sheet parts for the production of the heat-exchanger plates 3*a*, 3*b* according to the invention according to FIGS. 2 and 3. Here, the term "unfinished sheet" means in the scope of the present description that the shown, already plated or covered unfinished sheets have not yet been further processed (for example, shaped or provided with through-flow openings), in order to produce from this the ready-to-use heat-exchanger plates.

Figures 4, 4A, 4B:
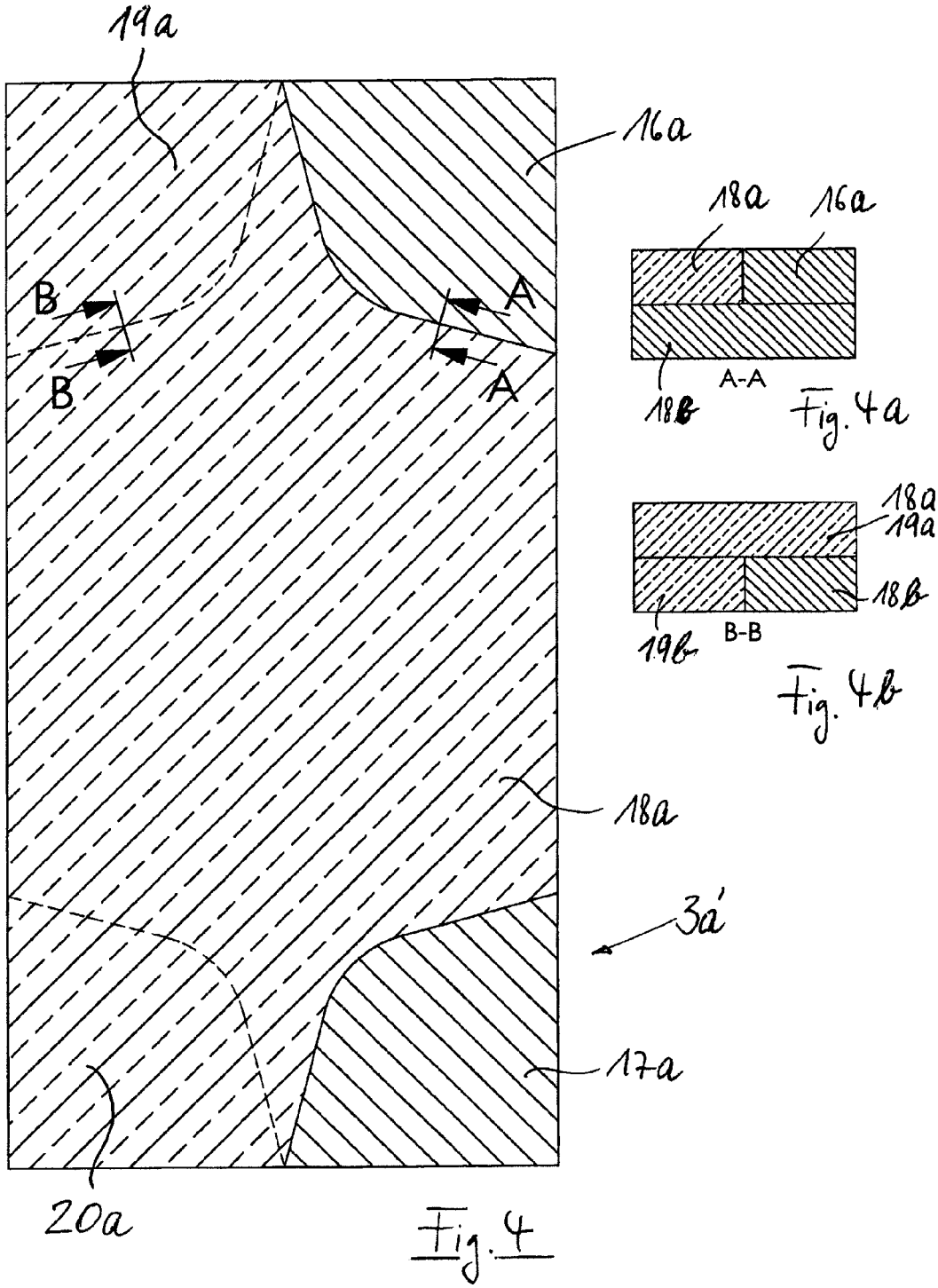

The unfinished sheet 3*a*' according to FIG. 4 is provided for the production of the heat-exchanger plate according to FIG. 2 and consequently has, on its illustrated front side, in the top and bottom, right connection regions 16*a* and 17*a*, the lower-grade material, while it is made from the high-grade material in the main, heat-exchanging region 18*a* and the connection regions 19*a*, 20*a* in flow connection with this region at the top and bottom, left regions.

FIGS. 4*a* and 4*b* show the cross sections A-A and B-B, respectively. Here, it can be seen in the upper half of FIG. 4*a* the already designated material transfer between high-grade, corrosion-resistant material and less corrosion-resistant material, while the lower region of FIG. 4*a* shows the relationships on the plate rear side, where the less high-grade material extends.

The relationships in FIG. 4*b* are different. Here, the more corrosion-resistant material extends on the front side of the plate, while the higher-grade material is needed only in the connection region 19*b* on the rear side, but not in the bordering, large surface area, heat-exchanging surface area 18*b*.

Figure 5:
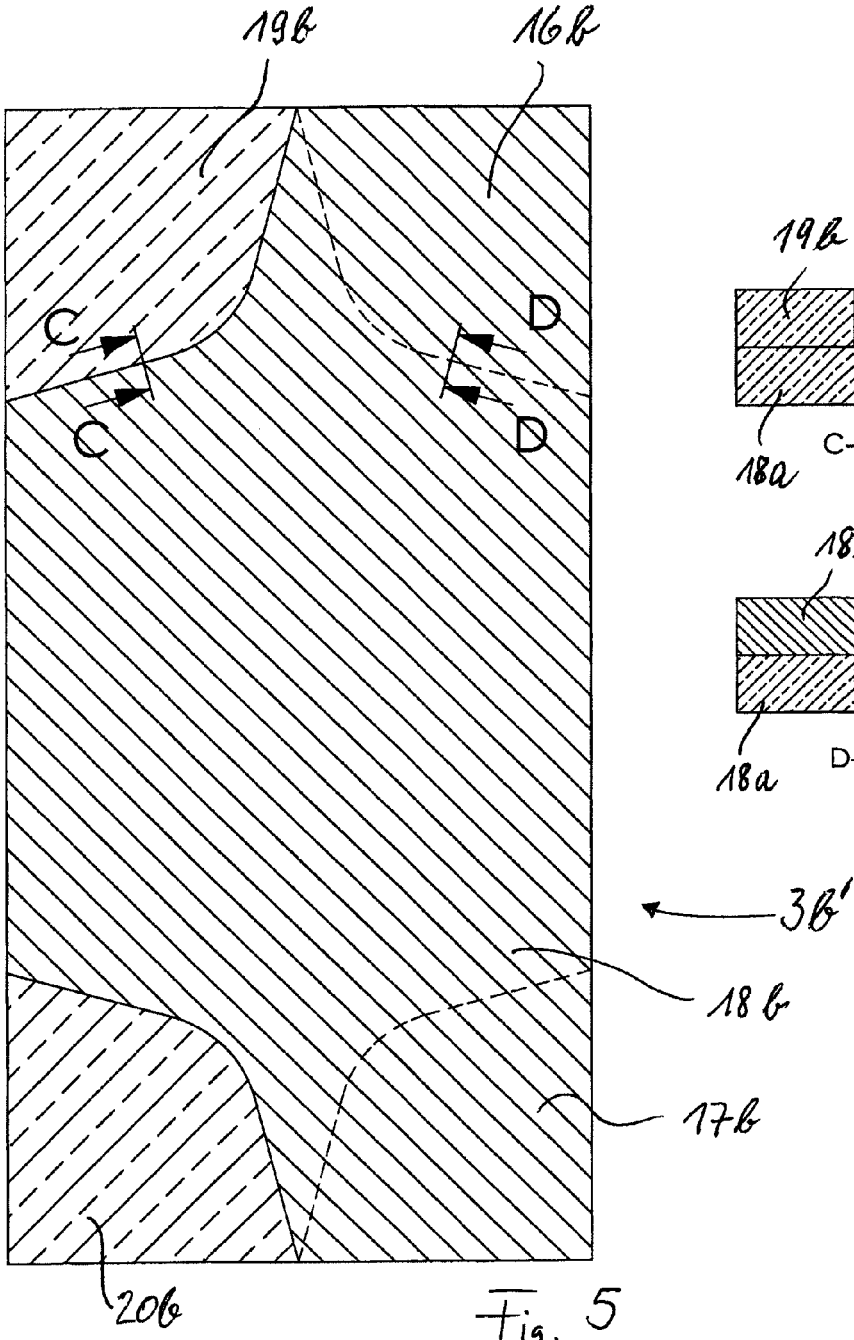
Figure 5A:
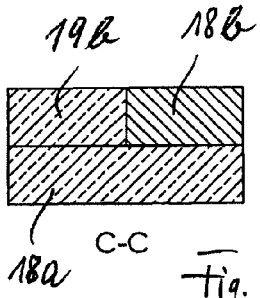
Figure 5B:
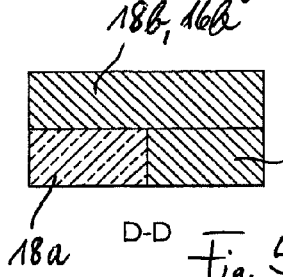

Analogously, FIG. 5 shows an unfinished sheet 3*b*' for heat-exchanger plates that are loaded with its front side primarily by the less aggressive medium. FIGS. 5*a* and 5*b* show section views along the lines C-C and D-D, respectively, in FIG. 5.

Here, the plate front side is made at the top and bottom, right, from the less corrosion-resistant material as in FIG. 3 in the large surface area, heat-exchanging region 18' as well as in the two connection regions 16*b*, 17*b* in flow connection with this region, while the connection regions 19*a*, 20*b* for the more corrosive medium at the top and bottom, left regions are made from the more corrosion-resistant material. These connection regions are in flow connection with the large surface-area heat-exchanging region on the plate rear side charged by the aggressive medium, so that the heat-exchanging region must be produced continuously from the more corrosion-resistant material. This is seen in FIG. 5*a*, where the lower half 18*a* shows the plate rear side.

Accordingly, in FIG. 5*b* one sees that, in the section region D-D, the plate front side 16*b*, 18*b* is made continuously from the less corrosion-resistant material, while the plate rear side has this material only in the connection region 16*a* for the less aggressive medium.

It also lies in the scope of the invention to form individual connection regions with only one layer. Thus, for example, in FIG. 2 and the corresponding FIGS. 4 and 4*a*, in the front position, the connection regions 16*a* and 17*a* are eliminated, so that only the rear position 18*b* is present there. The halving occurring here in the plate wall thickness can be bridged by a correspondingly thicker seal 5*a* and 7*a*. This one-layer construction is especially advantageous in those connection regions that are made from the higher-grade, more corrosion-resistant material. Here, the connection regions 19*b* and 20*b* could be eliminated according to FIG. 3 and the corresponding FIGS. 5 and 5*a* and the resulting halving of the plate thickness could be compensated by correspondingly thicker seals 4*b* and 6*b*.

For connecting the individual plate layers and layer parts, different options are available. For example, it is possible to first produce a complete plate bottom side and then a complete plate top side and then to connect these two layers to each other. Alternatively, however, at first only parts of the top and bottom sides could also be connected to each other and then the still missing connection regions could be connected. It is especially favorable, however, to assemble the plate from all of the parts of the top and bottom sides together with a solder as the bonding agent and then to generate the connection of all of the parts simultaneously by heating in a furnace.

According to the invention, in this way heat-exchanger plates are created for a plate-type heat exchanger, wherein these plates are in the position to withstand the effect due to a relatively aggressive medium, without the entire plate having to be constructed from a high-grade and correspondingly more expensive material.

The invention claimed is:

1. Heat-exchanger plate (3*a*, 3*b*) for a plate-type heat exchanger comprising a plate with through-flow openings (4-7) arranged in a plane of the plate for fluid media, the plate (3*a*, 3*b*) is constructed of a first material, and comprises a different material or is coated with the different material essentially only in those partial regions (18*a*; 19*a, b*; 20*a, b*) of its surface on at least one of a front or back side in which the heat-exchanger plate (3*a*, 3*b*) is adapted to come in contact with a relatively more aggressive of the fluid media, wherein the heat-exchanger plate (3*a*, 3*b*) has, on the front side and the back side, a large surface area, heat-exchanging region (18*a*, 18*b*) and at least four connection regions (16*a, b*; 17*a, b*; 19*a, b*; 20*a, b*) each containing one of the through-flow openings (4-7) for the heat-exchanging media, wherein the connection regions alternately open into the heat-exchanging region or are separated from the heat-exchanging region by seals (5*a*, 7*a*, 4*b*, 6*b*), the heat-exchanger plate (3*a*, 3*b*) is made from the different material or is coated with the different material on its surface (18*a*, 19*a*, 20*a*) adapted to come in contact in the heat-exchanging region (18*a*) with the relatively more aggressive of the fluid media, in the heat-exchanging region (18*a*) as well as the connection regions (19*a*, 20*a*) connected to the heat exchanging region with respect to flow, and the heat-exchanger plate (3*a*, 3*b*) is made from the different material or is coated with the different material on its surface (16*b*, 17*b*, 18*b*) coming in contact in the heat-exchanging region (18*b*) with the other of the fluid media only in the connection regions (19*b*, 20*b*) for one medium.

2. Heat-exchanger plate (3*a*, 3*b*) according to claim 1, wherein the heat-exchanger plate (3*a*, 3*b*) is made completely from the different material or is coated with different material in a region of breaks that form the through-flow openings (4-7) on their surface coming in contact with the relatively more aggressive of the fluid media.

3. Heat-exchanger plate (3*a*, 3*b*) according to claim 1, wherein the different material is made from a more corrosion-resistant material or is coated with the more corrosion-resistant material.

4. Heat-exchanger plate (3*a*, 3*b*) according to claim 1, wherein the different material is deposited on the first material through aluminization, vacuum deposition, anodization, sherardizing, chrome diffusion, phosphatization, vitreous enameling, plating, injection methods, hot dipping, galvanic action, soldering, hard soldering, or welding.

5. Heat-exchanger plate according to claim 3, wherein the plate is made from the more corrosion-resistant material or is coated with the more corrosion-resistant material both in connection regions (19*a*, 20*a*) for the aggressive medium and also in heat-exchanging region (18*a*) connected to the connection regions.

6. Heat-exchanger plate according to claim 1, wherein the plate is constructed with a relatively less corrosion-resistant material in connection regions (16*a*, 17*a*) adjacent to connection region or regions (19*a*, 20*a*) made from the more corrosion-resistant material.

7. Heat-exchanger plate according to claim 1, wherein a wall thicknesses of the more corrosion-resistant material and a relatively less corrosion-resistant material used in the connection regions (16*a*, 17*a*) adjacent to the connection region or regions (19*a*, 20*a*) made from the more corrosion-resistant material are approximately equal.

8. Heat-exchanger plate according to claim 1, wherein transitions between adjacent, differing corrosion-resistant material coatings on the surfaces of the plate extend into regions of the plate not charged with flow.

9. Plate-type heat exchanger for fluid media with at least one inlet (9) and at least one outlet (11) for a first slightly aggressive medium, with at least one inlet (12) and at least one outlet (10) for a second, more aggressive medium, and with a number of heat-exchanger plates (3) that are arranged in effective connection with respect to fluid with the inlets and the outlets in the plate-type heat exchanger, such that the media each flow in adjacent plate intermediate spaces, at least a few of the heat-exchanger plates (3) are constructed as a heat-exchanger plate (3*a*, 3*b*) comprising a first material, and a different material is provided or coated on the first material essentially only in those partial regions of its surface on at least one of a front or a back side in which the heat-exchanger plate is adapted to come into contact with the second more aggressive of the fluid media, wherein the heat-exchanger plate (3*a*, 3*b*) has, on the front side and the back side, a large surface area, heat-exchanging region (18*a*, 18*b*) and at least four connection regions (16*a, b*; 17*a, b*; 19*a, b*; 20*a, b*) each containing one of the through-flow openings (4-7) for the heat-exchanging media, wherein the connection regions alternately open into the heat-exchanging region or are separated from the heat-exchanging region by seals (5*a*, 7*a*, 4*b*, 6*b*), the heat-exchanger plate (3*a*, 3*b*) is made from the different material or is coated with the different material on its surface (18*a*, 19*a*, 20*a*) adapted to come in contact in the heat-exchanging region (18*a*) with the relatively more aggressive of the fluid media, in the heat-exchanging region (18*a*) as well as the connection regions (19*a*, 20*a*) connected to the heat exchanging region with respect to flow, and the heat-exchanger plate (3*a*, 3*b*) is made from the different material or is coated with the different material on its surface (16*b*, 17*b*, 18*b*) coming in contact in the heat-exchanging region (18*b*) with the other of the fluid media only in the connection regions (19*b*, 20*b*) for one medium.

10. Method for the production of a heat-exchanger plate (3*a*, 3*b*) for a plate-type heat exchanger, wherein front side of the plate is allocated to a less corrosive medium on its heat-exchanging surface (18*b*) and connection regions (16*b*, 17*b*) in flow connection with the front side heat-exchanging surface are produced from a less corrosion-resistant material, connection regions (19*b*, 20*b*) for a corrosive medium and made from a more corrosion-resistant material are connected to these regions, while on a back side of the plate, the heat-exchanging surface (18*a*) and the connection regions (19*a*, 20*a*) in flow connection with the back side heat-exchanging surface for the more corrosive medium and made from a more corrosion-resistant material and the remaining connection regions (16*a*, 17*a*) made from the less corrosion-resistant material are produced, wherein the heat-exchanger plate (3*a*, 3*b*) has, on the front side and the back side, at least four of the connection regions (16*a, b*; 17*a, b*; 19*a, b*; 20*a, b*) each containing one through-flow opening (4-7) for the heat-exchanging medium, wherein the connection regions alternately open into the heat-exchanging region or are separated from the heat-exchanging region by seals (5*a*, 7*a*, 4*b*, 6*b*), the heat-exchanger plate (3*a*, 3*b*) is made from the more corrosion-resistant material or is coated with the more corrosion-resistant material on the surfaces (18*a*, 19*a*, 20*a*) adapted to come in contact in the heat-exchanging region (18*a*) with the more corrosive medium, in the heat-exchanging region (18*a*) as well as the connection regions (19*a*, 20*a*) connected to the heat exchanging region with respect to flow, and the heat-exchanger plate (3*a*, 3*b*) is made from the less corrosion-resistant material or is coated with the less corrosion-resistant material on the surfaces (16*b*, 17*b*, 18*b*) coming in contact in the heat-exchanging region (18*b*) with the less corrosive medium only in the connection regions (19*b*, 20*b*) for less corrosive medium, and the materials are connected to each other in a fitting way, whereupon a multi-layer plate formed in this way is profiled.

11. Method according to claim 10, wherein the layers of a plate are completely set together with the heat-exchanging regions (18*a*, 18*b*) and all of the connection regions (19*a*, 19*b*, 20*a*, 20*b*) with a bonding agent and are then connected to each other simultaneously.

12. Method according to claim 11, wherein solder is used as the bonding agent and the connection is performed in a furnace.

13. Method according to claim 10, wherein the different plate regions are connected by soldering.

14. Method according to claim 10, wherein the formed, multi-layer plate is drilled before or after the profiling.

15. Method according to claim 10, wherein unfinished sheets used for forming the multi-layer plate are drilled before a connection to the multi-layer plate.

16. Method for the production according to claim 10, wherein continuous layers of one and the same material are produced in asymmetric form and the continuous layers are expanded by the connection regions made from the other material.

17. Method according to claim 10, wherein only core regions (18*a*, 18*b*) of the sheet layers are produced without connection regions.

18. Method according to claim 10, wherein the connection regions (16*a*, 17*a*, 19*b*, 20*b*) are present with twice a wall thickness.

* * * * *